US005454747A

United States Patent [19]

Ascalon

[11] Patent Number: 5,454,747

[45] Date of Patent: Oct. 3, 1995

[54] FACETING MACHINE

[76] Inventor: Adir Ascalon, 35 E. 35th St., New York, N.Y. 10016

[21] Appl. No.: 142,506

[22] Filed: Oct. 22, 1993

[51] Int. Cl.[6] ..... B24B 49/00

[52] U.S. Cl. ..... 451/5; 451/11; 451/41; 451/259; 451/389; 125/30.01

[58] Field of Search ..... 451/41, 57, 259, 451/264, 266, 268, 272, 274, 276, 279, 285, 265, 389, 5, 11; 125/30.01

[56] References Cited

U.S. PATENT DOCUMENTS

| | | | |
|---|---|---|---|
| 515,595 | 2/1894 | Linden . | |
| 1,575,156 | 7/1923 | Ecaubert . | |
| 3,279,127 | 10/1966 | Giezentanner | 451/389 |
| 3,404,491 | 10/1968 | Emain | 451/389 |
| 3,811,229 | 5/1974 | Montgomery . | |
| 3,940,888 | 3/1976 | Wain . | |
| 4,603,512 | 8/1986 | Cave et al. . | |
| 4,624,081 | 11/1986 | Janutta | 451/279 |
| 4,715,148 | 12/1987 | Landgraf . | |
| 5,155,943 | 10/1992 | Matsutani et al. | 451/28 |

FOREIGN PATENT DOCUMENTS

| | | | |
|---|---|---|---|
| 1502412 | 2/1969 | Germany | 451/389 |
| 3819602 | 3/1989 | Germany | 451/389 |

*Primary Examiner*—Maurina T. Rachuba
*Attorney, Agent, or Firm*—Bachman & LaPointe

[57] ABSTRACT

A machine is disclosed for forming facets on the surfaces of a plurality of workpieces. The machine is characterized by the presence of a plurality of pin members for holding the workpieces to be faceted against an abrading surface of a lap or a grinding wheel. The pin members are positioned and held together in a contiguous relationship. The machine also includes a mechanism for setting the angular relationship of the pin members relative to the lap or grinding wheel and for causing rotational or gyrational movement of the pin members.

32 Claims, 6 Drawing Sheets

FACETING MACHINE

BACKGROUND OF THE INVENTION

The present invention relates to a machine for shaping or faceting workpieces such as gemstones. The machine may also be used for shaping industrial diamonds and metals such as carbide steel for cutting tools.

A variety of machines for faceting and otherwise processing gemstones are known in the art. One such early machine is shown in U.S. Pat. No. 515,595 to Linden. The Linden patent relates to a work-holder for grinding machines used to grind articles such as precious stones. The work-holder for holding the precious stones on the abrading face of a lap or other grinding stone has a series of shafts adapted to be turned in unison, and drops carrying the stones and connected by universal joints with the shafts. A gear system is used to rotate the shafts.

U.S. Pat. No. 3,404,491 to Emain relates to a gem working machine having a plurality of parallel stone-carrying spindles mounted on a frame. One end of each spindle carries a stone to be worked, while the other end is rotated by a driving mechanism.

U.S. Pat. No. 3,940,888 to Wain illustrates a faceting device for gemstones. The device orients a gemstone for forming facets thereon in a plurality of coaxial rows with equal spacing of the facets in the rows. A dop stick is provided on the end of a faceting shaft secured in a quill sleeve rotatably mounted in a faceting head which can be angularly adjusted for different facet rows to be formed. A spring-biased detent trigger is pivoted on the bracket to engage between the teeth of an indexing gear secured on a collar on the quill sleeve near the other end of the shaft. A positioning pin is secured to the collar and projects through the gear. A guide disc having evenly spaced peripheral notches is engaged around and can be rotated on a flange bushing threadably engaged on the quill sleeve adjacent the gear. A coil spring is provided on the bushing for urging the disc toward the gear. The disc has respective holes spaced to receive the pin to establish the angular relationship between the successive rows of evenly spaced facets. The notches on the guide disc move the detent trigger into engagement between the gear teeth for assuring uniform angular rotational steps of the shaft in forming the facets of a particular row.

U.S. Pat. No. 4,603,512 to Cave et al. relates to an apparatus for lapping a facet at the tip of a stylus by softly setting the tip down adjacent a rotating scaife which comprises a movable carriage supported on a platform by a means for translating the carriage along a first horizontal axis. The carriage is moved vertically along a second axis substantially orthogonal to the first axis. A stylus holder in the form of a turret operates to pivot the stylus toward the scaife and is biased by a spring or weight to assure a soft set down of the stylus tip on the scaife. A displacement sensor senses the angular displacement of the holder and generates a displacement signal proportional to the angular displacement relative to a predetermined reference position.

U.S. Pat. No. 4,715,148 to Landgraf relates to yet another gem faceting machine. The Landgraf machine has a main working spindle which can be pivoted in a vertical plane to obtain various inclinations of its axes. The spindle is amenable to height adjustment and is capable of being rotated about its own axis. There is also provided a means for latching the rotational position of the spindle in particular positions as well as in positions in-between the particular positions. The machine has a multiple gem mounting structure which includes a multiple chuck mounting element connected to the spindles for being turned therewith. The mounting structure also has a plurality of bores containing sleeves which in turn receive pin receiving spindles serving as rotatable chucks. It also includes a rotatable and position arrestable actuating element. A cover having a circle of latch bores is provided and a central drive element is coupled for rotation to the pin receiving spindles by means of gear pairs. An indexing pin holds the cover in one of the positions defined by the bores. A plurality of gem mounting pins are directly or, through an adapter element, indirectly mounted to the spindles. For latching the main spindle, one either uses existing latch equipment or integrates the same with the chuck mounting element.

U.S. Pat. No. 3,811,229 to Montgomery also relates to a gem faceter. The Montgomery faceter comprising a pivot block which is vertically movable to various positions. A pivot arm is pivotally mounted at one end to the pivot block. A head is mounted to the other end of the pivot arm and is adapted for movement to various positions about a pivot pin. A dop is mounted in the head and adapted to be rotated about its axis to various positions. An index plate is fixedly mounted on the dop. The index plate has markings thereon which indicate the number and position of desired facets to be ground on a gem held by the dop. An index plate clamp for locking the index plate successively in the desired marked positions relative to the head for grinding the facets is provided. A lapping table is adapted to be contacted by the dopped gem. A protractor is provided for continuously indicating the angular position of the dop relative to the vertical. An adjustment stop is provided for limiting the movement of the head toward the lapping table. A sensor is mounted on the stop for sensing the degree of movement of the head toward the lapping table. An electronic circuit for translating the degree of movement sensed by the sensor into an electronic signal and a visual indicator for indicating the value of the electronic signal and the degree of the movement are provided so that the faceting angle may be detected and duplicated with a degree of precision.

U.S. Pat. No. 1,575,156 to Ecaubert relates to a machine for grinding and polishing gemstones. The Ecaubert machine has a revolvable lap member together with a revolvable drum or work carrying member adapted to revolve in an opposite direction. The machine is constructed so that the revolvable work member oscillates over the lap member in order to bring the surface of the article to be ground successively into contact with all portions of the grinding surface of the lap member. The oscillating movement is controlled so as to cause a substantially even wear on the entire surface of the lap member.

Despite the existence of these machines for faceting and otherwise processing gemstones, there still remains a need for a machine that is capable of faceting a great volume of workpieces in a relatively small area. One of the problems with prior art machines is the extensive use of gearing arrangements which increased the space occupied by the machine and which prevented workpiece holding tools from being operated in unison. Such machines are only capable of faceting only fifteen stones at a time. This is because gear technology machine work in a linear formation and extend no more than ten inches. The gears also tend to malfunction quite often because they do not transmit well. A machine is also needed which increases productivity and is less costly to operate.

SUMMARY OF THE INVENTION

Accordingly, is it an object of the present invention to provide a faceting machine that is capable of processing a great volume of stones in a smaller area.

It is also an object of the present invention to provide a machine as above which is more productive and less costly to operate than prior art machines.

It is a further object of the present invention to provide a machine which avoids the use of unnecessary gear arrangements.

Other objects and advantages of the present invention will become more apparent from the following description and the accompanying drawings wherein like reference numerals depict like elements.

The faceting machine of the present invention attains the foregoing objects and advantages. In accordance with the present invention, a machine is provided for forming facets on the surfaces of a plurality of workpieces. The machine is characterized by the presence of a plurality of pin members for holding the workpieces to be faceted against an abrading surface of a lap or a surface grinding machine. The pin members are positioned and held together in a contiguous relationship. The machine also includes means for setting the angular relationship of the pin members relative to the lap or grinding wheel and for causing rotational or gyrational movement of the pin members. This angle changing and rotational movement causing means is preferably controlled by a servo-control, although it may be manually controlled as well.

Other details of the faceting machine of the present invention are set forth in the following detailed description.

DETAILED DESCRIPTION OF THE PREFERRED EMBODIMENT(S)

Figure 1:
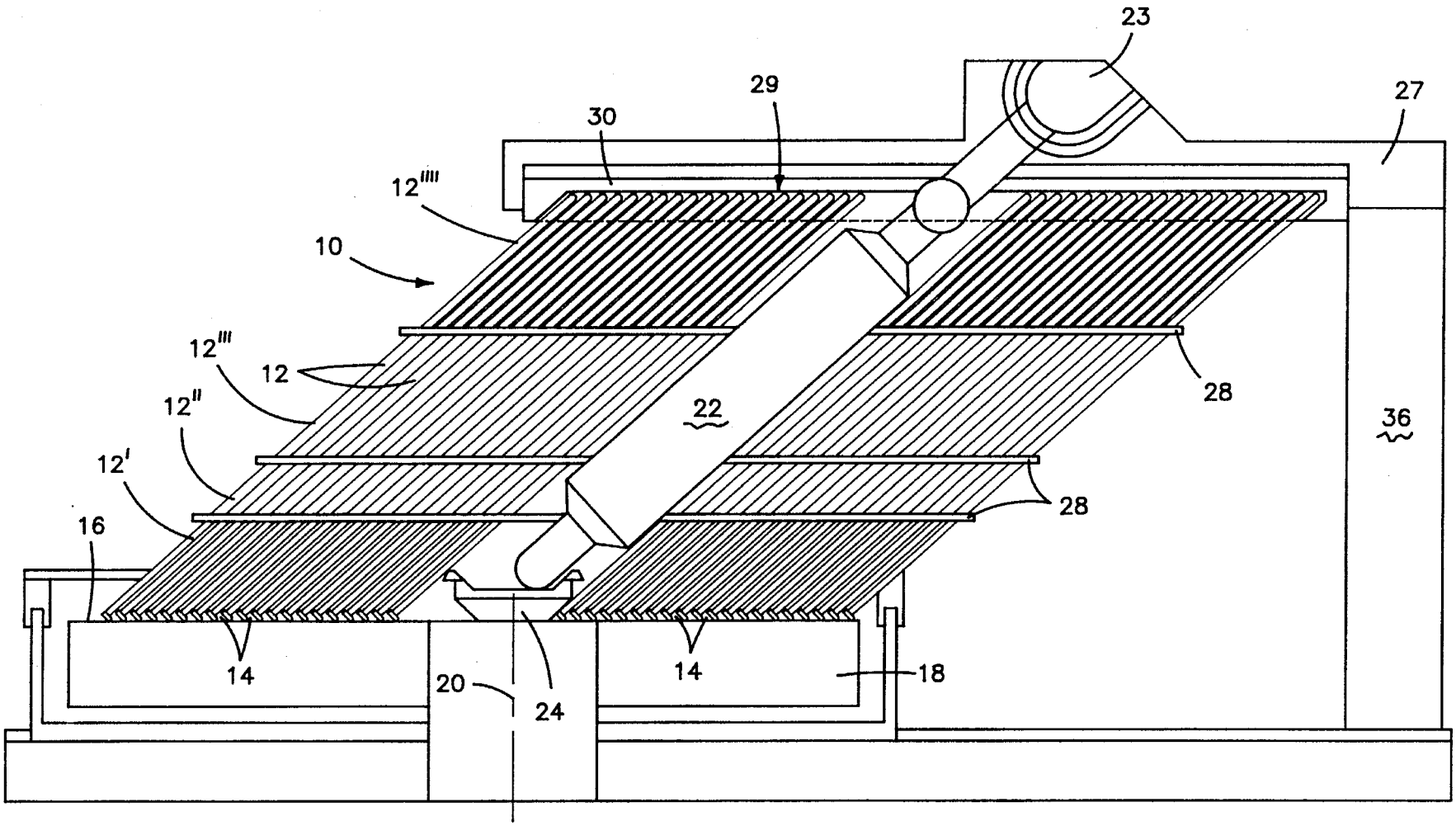
FIG. 1 illustrates a first embodiment of a faceting machine in accordance with the present invention.

Referring now to the drawings, FIG. 1 illustrates a first embodiment of a faceting machine in accordance with the present invention. The faceting machine (10) has a cluster of pins (12) for holding a number of workpieces (14) such as gemstones, industrial diamonds, or a hard steel workpiece such as carbide steel for cutting tools. The pins (12) are aligned so their longitudinal axes are parallel to each other. Additionally, they are arranged to be contiguous to one another. Still further, the pins (12) have identical outer surface geometries to facilitate any vertical or perpendicular sliding action. Each of the pins (12) may have an outer surface with any desired shape including, but not limited to, a hexagonal or square outer surface.

Figure 8:
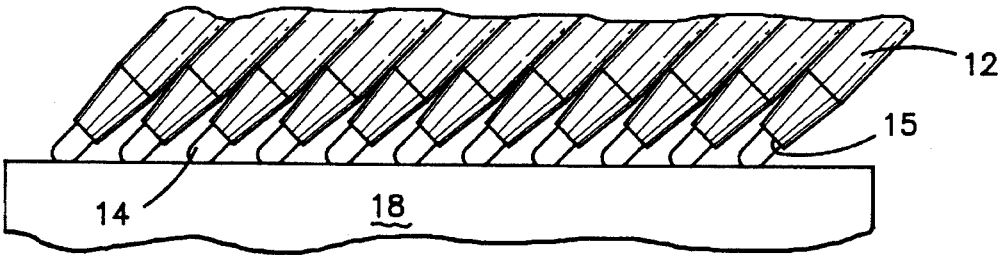
FIG. 8 illustrates the tip portions of the pin members for holding the workpieces.

The pins (12) are used to hold the workpieces (14) against an abrading surface (16) of a cutting lap (18) and to assist in applying shaping forces to the workpieces. To this end, each pin has a hollow tip portion (15) as shown in FIG. 8 for receiving a workpiece (14). The cutting lap is preferably rotatable about an axis (20) by a motor (not shown). When the pins (12) are holding the workpieces (14) against the surface (16), the workpieces all lie in substantially the same plane because the surface (16) is substantially planar.

Centrally located within the cluster of pins is an indexing pin (22). One end of the indexing pin is fixedly mounted within a cup-shaped member (24) to form a fixed pivot point about which the pin (22) may be pivoted from side to side and from front to back and/or rotated or gyrated through a 360° range of motion. The opposite end of the pin is connected to a servo-control mechanism (23) capable of moving the pin (22) along at least two orthogonal axes. As a consequence of this construction, the upper end of the pin (22) is also movable or gyratable through a 360° range of motion in a plane substantially parallel to the abrading surface (16). The pin (22) is also adjustable over an angular range relative to the surface (16). The servo-control can be operated through any suitable means known in the art such as a programmed computer (not shown). If desired, the servo-control may also be manually operated. In a preferred embodiment of the present, the servo-control is computer assisted.

By changing the angular relationship of the pin (22) with respect to the surface (16), the angular relationship of all of the pins (12) can be adjusted from side to side and/or from back to front. Additionally, by gyrating rotating the pin (22) in the manner described above, one can cause similar gyrational movement of the pins (12) through a 360° range of motion. Through the combination of angle adjustments and rotational movements, it is possible to form a number of different shaped facets on the workpieces. It is also possible to shape a workpiece so as to form curved surfaces thereon. One of the unique advantages of the present invention is the fact that all of the pins are designed to move together. As a result, substantially the same forces can be applied to each of the workpieces (14) being faceted. Additionally, one pin is equal to the sum of all of the pins.

Figure 9:
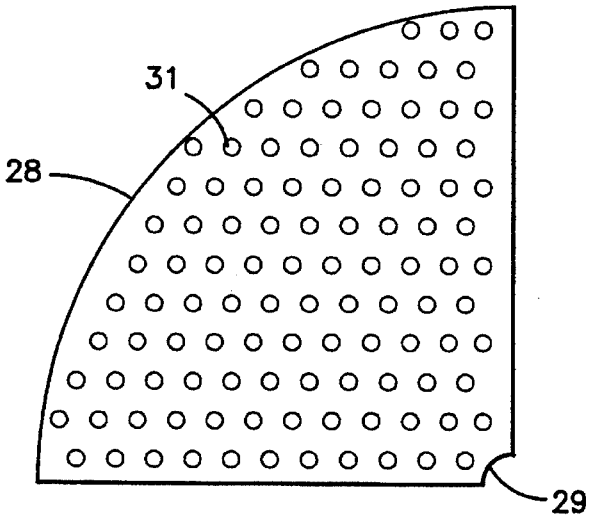
FIG. 9 illustrates a portion of a holding plate for retaining the pin members in a contiguous relationship.

To maintain the pins (12) in contiguous relationship, a pin retaining mechanism (28), such as holding plates (28), is provided. As can be seen from FIG. 1, three holding plates (28) can be provided along the length of the pins. Each of the holding plates can have any desired exterior shape. FIG. 9 illustrates a portion of one holding plate which can be used to hold the pins (12). The plate includes a central opening (29) for the indexing pin (22) and a plurality of apertures (31) for fitting around recessed portions (not shown) in the pins. When the plate (28) is used, each pin (12) may be formed by a plurality of interconnectable segments (12', 12", 12''', etc.). Where two segments are mated together, the recessed portion is formed. The various segments of the pins may be joined together in any suitable manner such as by mating threads.

In lieu of holding plates (28), the pin retaining mechanism

(28) could be a ring shaped member for holding the pins (12) in a contiguous relationship. For example, the retaining mechanism could be a spring ring, having an open central portion, which fits around the circumference of the pins. A spring ring is one preferred arrangement because it is flexible and capable of holding the pins regardless of both angular changes and positional changes caused by gyration of the pins.

In addition, the pin retaining mechanism includes a top holding plate (30) having a recessed portion (29) for receiving the upper ends of the pins (12) and a series of electromagnets (not shown) for holding the pins in position. The electromagnets may be mounted to the plate or embedded therein. The plate (30) is preferably mounted by any suitable means known in the art to move along at least two orthogonal axes to accommodate movement of the pins.

The electromagnets are used to create a magnetic field which interacts with steel alloy balls (34) at the upper end of each pin (12). As a result, when the plate (30) is moved during angle and degree indexing, the pins (12) will move in unison to the same degree. The plate (30) may be caused to move by the servo-control (23) or some other mechanism.

The machine (10) may also include means (not shown) for moving the plate (30) upwardly and downwardly. Any suitable conventional means known in art may be used to provide the up and down movement of the holding plate (30). Such movement is necessitated in part by the angular changes to the pins (12).

A pneumatic mechanism (not shown) is preferably provided to lower the workpiece loaded pins (12) onto the abrading surface of the cutting lap. The pneumatic mechanism may comprise any suitable pneumatic system known in the art and may be provided within a column (36) attached to the plate (30) by support structure (27).

The pins (12) may be made of any durable material such as bronze, steel or a plastic material. Obviously, when the pins are manufactured without the steel balls (34), the top holding plate does not need to have the aforementioned electromagnets. If the pins (12) are provided with steel alloy balls (34), then the pins (12) should not be manufactured from steel.

Figure 5:
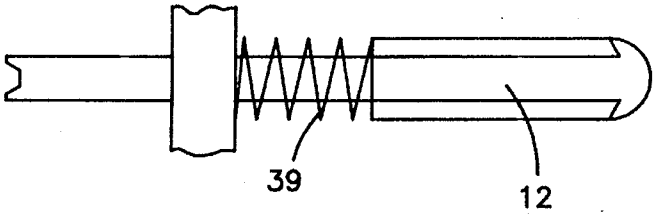
FIG. 5 is an alternative embodiment of a pin construction which can be used in the embodiments of FIGS. 1 and 2.
Figure 4:
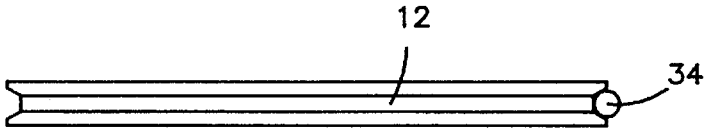
FIG. 4 is a first embodiment of one of the pins used in either of the machines shown in FIG. 1 or FIG. 2.

As shown in FIGS. 4 and 8, each pin may have a hollow tip portion (15) in one end to accommodate the workpiece (14) and a steel alloy ball (34) at the opposite end. As previously discussed, the ball (34) interacts with the electromagnets in the plate (30) as part of the pivoting or rotational movement of the pins. The ball (34) also interacts with the electromagnets in the plate to lift the pins from the cutting lap and for holding the pins rigidly in place against the upper plate. Alternatively, each pin could be shaped in the manner shown in FIG. 5. As shown therein, the pin (12) is rounded at one end to facilitate angle and indexing degree changes. The pins could be hollow if desired for gluing purposes. A spring (39) is provided to keep the pin back towards the top holding plate. The spring (39) may accomplish this by interacting with a surface of a pin retaining mechanism.

In operation, the stone-loaded pins (12) are lowered onto the rotating, cutting lap (18). During this faceting mode, the cluster of pins (12) move in unison from side to side and/or front to back and/or through all or part of a 360° range of motion to facilitate the cutting process. Once a desired cut is achieved, the pins and the top holding plate (30) are raised. The plate (30) is then disengaged from the pins. When the plate (30) is provided with electromagnets, disengagement is accomplished by shutting the electromagnets off. This allows the pins (12) to be moved to the next desired cut. All of the holding pins (12) are then shifted to a new angle via the rotating pin (22) and the servo-control. Thereafter, the top plate is re-engaged and the pins are again lowered to the cutting lap, in unison, for the next cutting step. This process is continued until the cutting process is completed and the finished, faceted stones have been produced.

Figure 2:
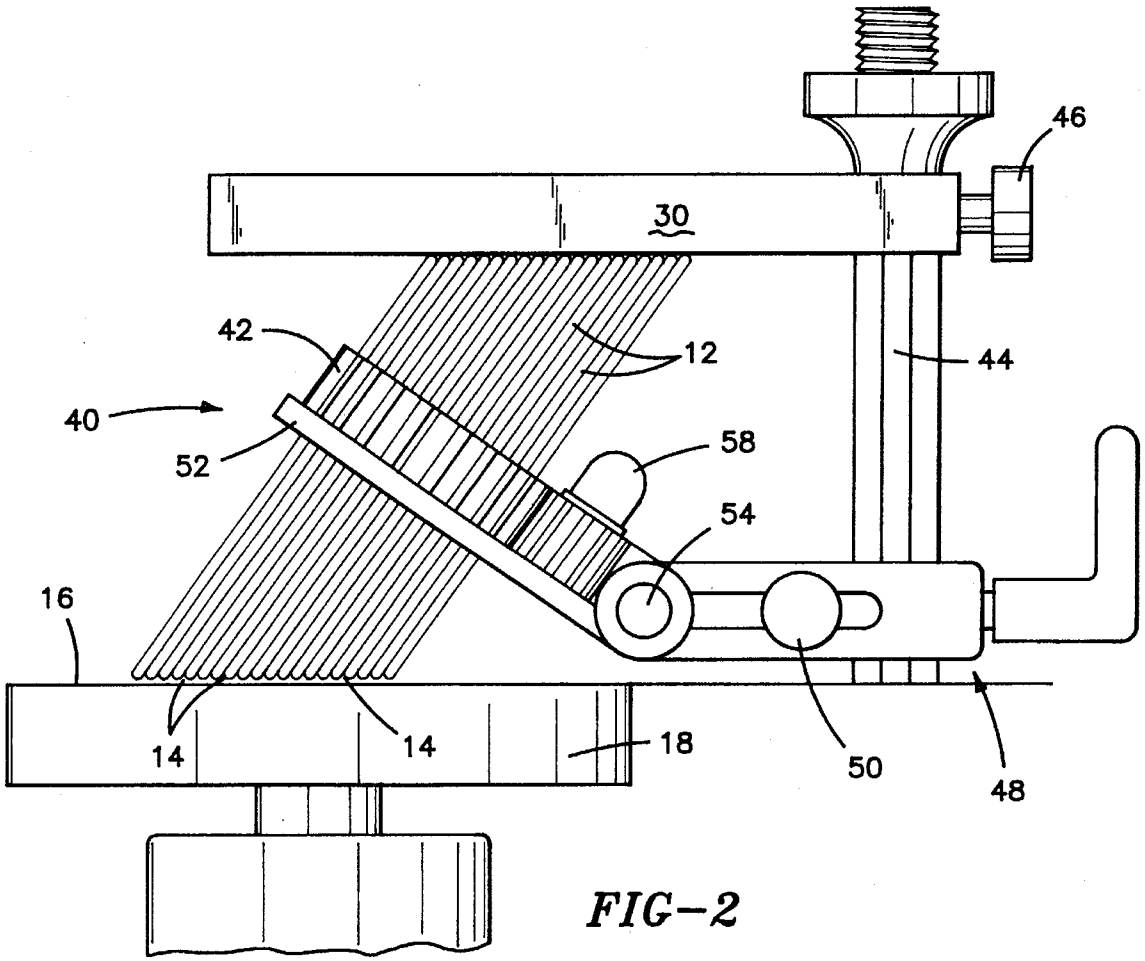
FIG. 2 illustrates a second embodiment of the faceting machine of the present invention.

Referring now to FIG. 2, a second embodiment of a faceting machine (40) is illustrated therein. In this embodiment, the central indexing pin is replaced by a main gear (42) which surrounds the cluster of holding pins (12). The holding pins, as in the embodiment of FIG. 1, have hollow tip portions for receiving a workpieces (14) and are pressable against the abrading surface (16) of a rotating cutting lap by a pneumatic mechanism (not shown).

As shown in FIG. 2, a vertical post (44) is provided along which the top holding plate (30) can be moved up and down. As before, the top plate is configured to receive the upper ends of the pins (12) and to accommodate rotation of the pins. Nut means (46) may be used to permit the movement of the plate (30) along the post (44) and to lock the plate (30) in a desired position relative to the abrading surface (16). A separate pneumatic mechanism (not shown) may be used to a automatically position and/or rotate the plate to accommodate rotational movement of the pins.

Also mounted to the post (44) is an adjustment mechanism (48). The adjustment mechanism also slides along the post. A screw-type lock means (50) is provided to fix the adjustment means in a desired position along the post (44). If desired, the positioning of the mechanism (48) can be done automatically by still another pneumatic mechanism (not shown).

As can be seen in FIG. 2, the main gear (42) is mounted on a plate (52) which is hingedly connected to the adjustment mechanism (48) by hinge mechanism (54). The hinge mechanism allows the plate to change its angular position relative to the main body of the adjustment mechanism (48) as the mechanism (48) is moved up and down the post (44).

The main gear (42) has gear teeth around substantially it entire periphery. Additionally, the gear has a central opening (57) for receiving the cluster of pins (12). The shape of the central opening (57) corresponds with the shape of the pins. Thus, for square pins, the opening is square; for hexagonal pins, the opening is hexagonal; and so forth. The main gear (42) also has a series of electromagnets (56) about its periphery for locking the pins in a desired cutting position.

Figure 3:
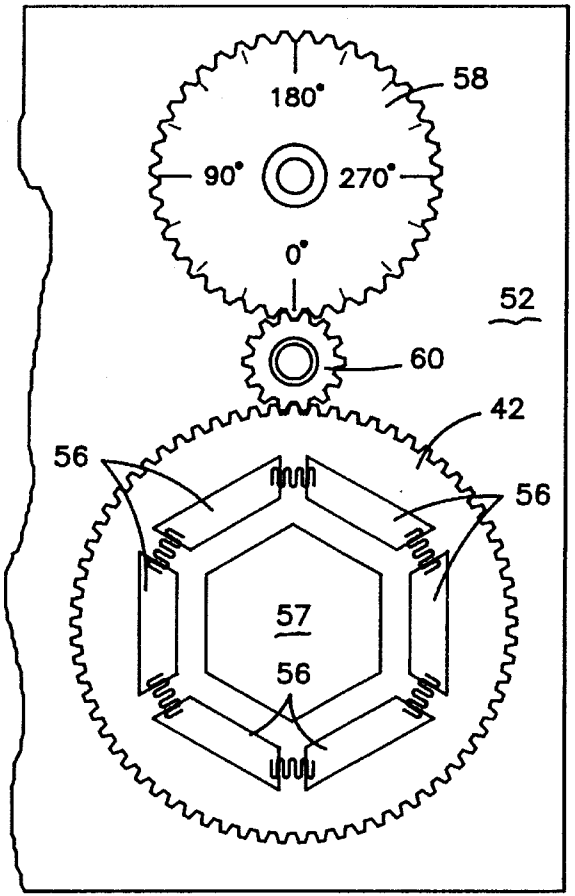
FIG. 3 is a top view of a gear arrangement used in the embodiment of FIG. 2.

As shown in FIG. 3, a device (58) is provided to rotate the main gear in a desired manner. The device (58) may be inscribed with degree numbers. The device (58) may be manually operated or may be operated automatically with computer assistance. The device (58) has gear teeth which mate with gear teeth on an intermediate gear (60) which, in turn, has gear teeth which mate with the gear teeth on the main gear (42). The main gear (42) when rotated by the device (58) rotates the pins (12) and thereby achieves faceting in the round. Through the aforementioned means, each rotation is indexed to the correct degree to be faceted.

In operation, the adjustment mechanism (58) is moved into a desired position along the post (44). This positions the main gear at a desired angle relative to the surface (16) of the cutting lap. This in turn causes the pins (12) to move to a desired angular position relative to the surface (16). After the main gear (42) has been adjusted, the top holding plate (30) is moved and locked into its position so as to assist in pressing the pins against the abrading surface (16) of the lap (18). The main gear is then rotated by the device (58). This rotates the pins (12) so that an initial cutting of the stones is made along at least one surface thereof. After the desired cut has been effected, the rotation of the main gear is stopped. The top holding plate (30) is raised so as to allow movement of both the pins (12) and the main gear which are then reset to the desired position for the next cut. The top plate is then lowered back into position and the process is repeated until all of the desired cuts are made and the finished, faceted stones are produced.

Figure 6:
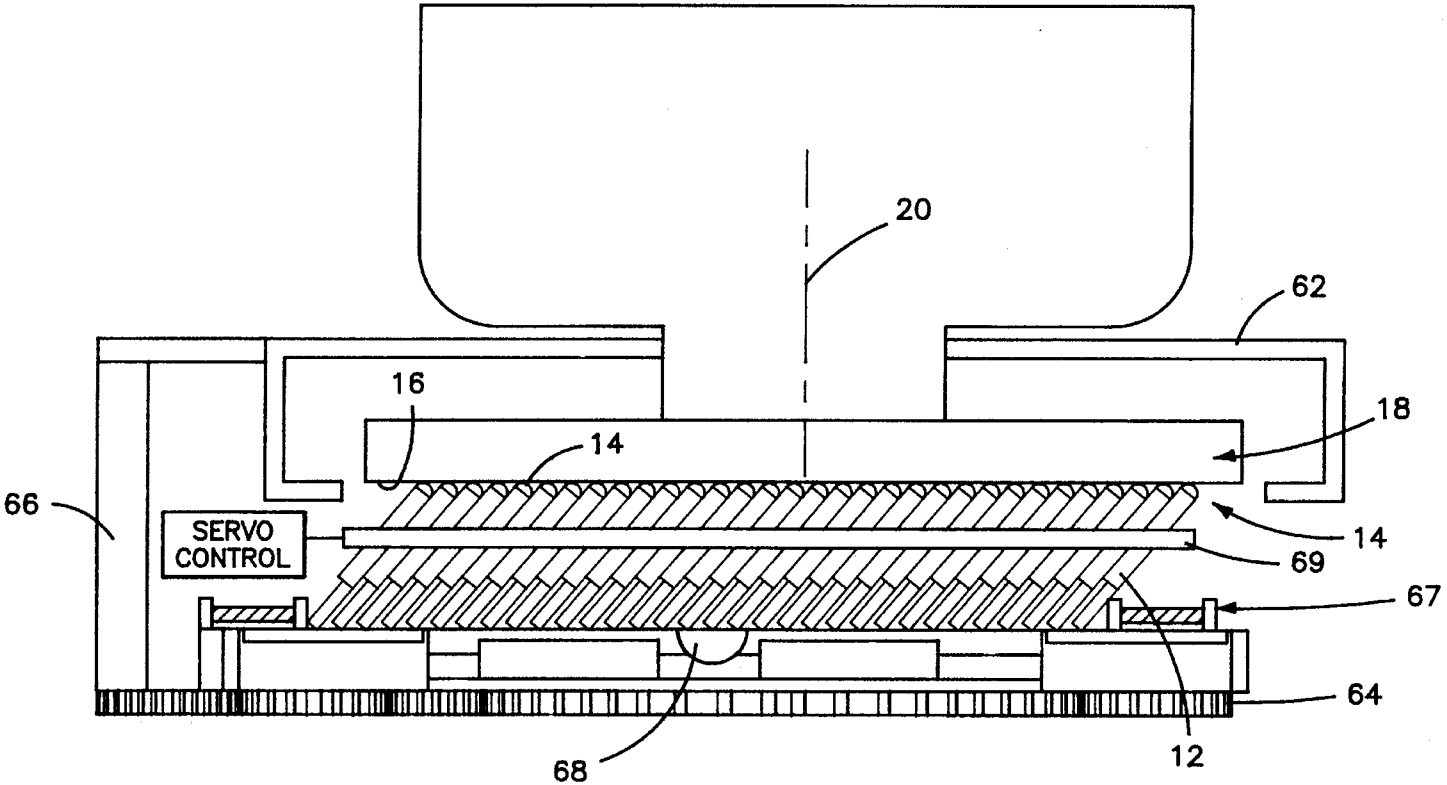
FIG. 6 illustrates a third embodiment of a faceting machine in accordance with the present invention.

FIG. 6 illustrates a variation of the embodiment of FIG. 1 wherein the cutting lap (18) is positioned above the holding pins (12). This faceting machine operates in substantially the same fashion as the machine of FIG. 1. A bottom plate (64), preferably an electromagnetic base plate, is provided to hold tight and release the pins (12) in an on- and off- cycle. The pins are held in place and released by switching on and off electromagnets attached to or embedded in the plate (64).

Figure 10:
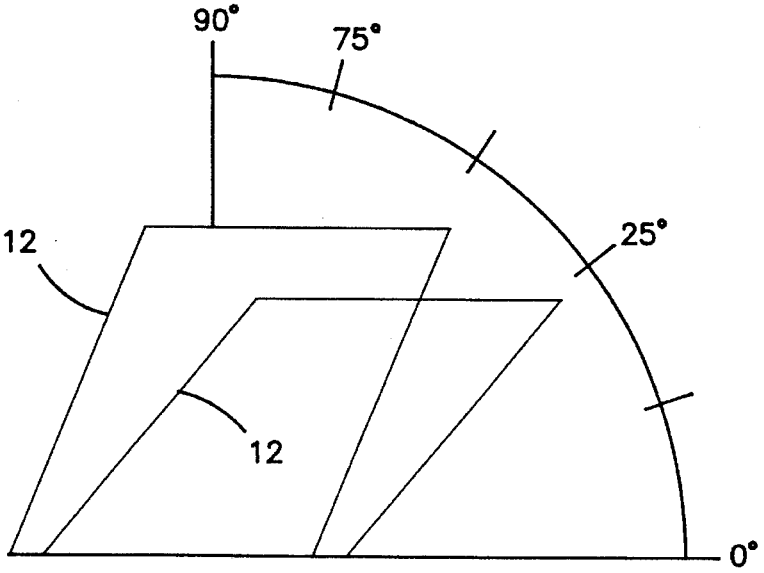
FIG. 10 illustrates the angular movement of the pins in the embodiment of FIG. 6.

The plate (64) is attached to a column (66) in which a mechanism such as a pneumatic device (not shown) is located to move the plate (64) towards and away from the lap (18). An indexing pin (68) is provided to slant all pins at a desired angle relative to the surface (16) of the lap (18). In this device, the pins (12) pivot and are angled towards only one direction as shown in FIG. 10 to achieve the angles of the facets to be cut. The pin (68) may be moved by a servo-control device or other conventional control means (not shown).

To hold the pins (12) in place, a holding plate or spring ring (69) is also provided. A border element (67) may also be provided. If desired, a cover (62) may be provided over the lap.

Figure 7:
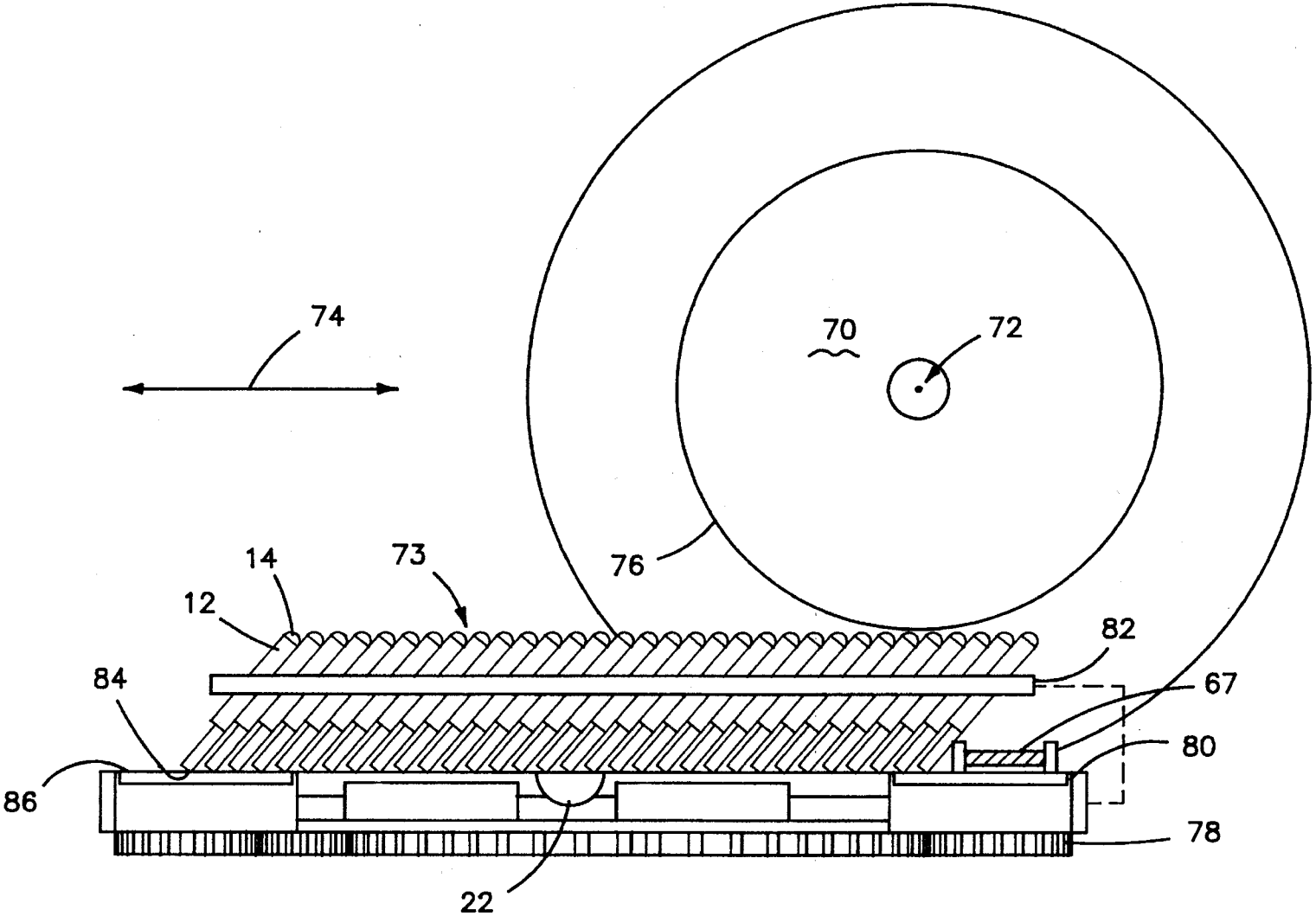
FIG. 7 illustrates a fourth embodiment of a faceting machine in accordance with the present invention.

FIG. 7 illustrates another embodiment of the present invention wherein the cutting lap is replaced by a surface grinding machine (70). The machine (70) rotates about an axis (72) which extends substantially perpendicular to a plane (73) containing all of the workpieces. The grinding machine (70) is movable along an axis (74) which is parallel to the surface of the plane (73) containing all of the workpieces. Any suitable means known in the art may be used to move the grinding machine (70) along the axis (74) and cause the grinding machine to rotate about the axis (72).

Figure 11:
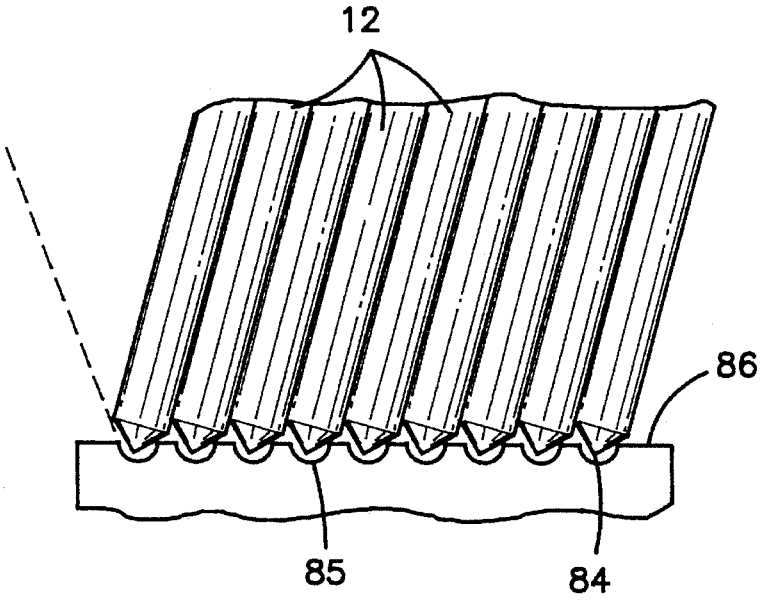
FIG. 11 is an enlarged view of a portion of the machine of FIG. 7.
Figure 12:
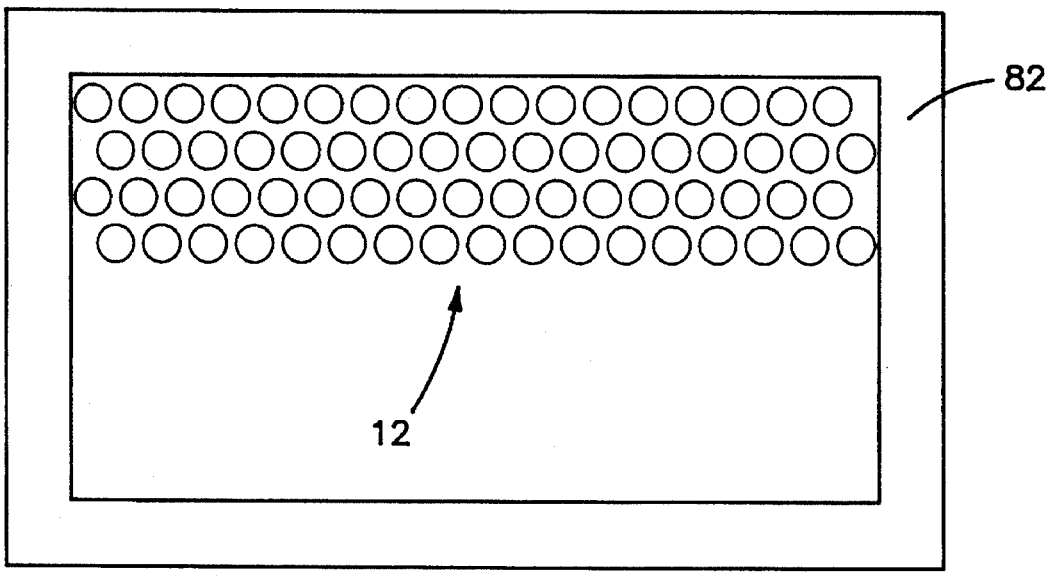
FIG. 12 is a top view of the locking frame used in the embodiment of FIG. 7.

As before, the pins (12) are used to hold the workpieces being cut against the abrading surface (76) of the grinding machine. In the embodiment of FIG. 7, the pins (12), affixed by gravity, rest on the bottom of an electromagnetic base plate (78) whose function is to hold tight and release the pins in an ON and OFF cycle. In this embodiment, the cutting action is performed without the side motion used in the embodiments of FIGS. 1 and 2. This is done mainly to facilitate quicker production and to avoid destroying the cutting laps. A servo-control mechanism (80) and a locking frame (82) are provided for gyrating the pins (12) in unison on their bottom tips (84) through a 360° range of motion. The pins are held in place against bottom plate (78) by electromagnets (not shown). As shown in FIG. 11, each pin tip (84) is positioned within a shallow indentation (85) in a surface (86) of the plate (78). The locking frame (82) may comprise any suitable means known in the art to hold the pins together such as a holding plate similar to plate (28). It may be connected to the servo-control (80) by any suitable means known in the art. The locking frame is driven by the servo-control (80) along at least two orthogonal axes lying in a single plane to cause the gyrational movement of the pins (12). This embodiment has particular utility in the production of carbide steel cutting or milling tools.

As can be seen from the foregoing discussion, a faceting machine has been provided which enables a plurality of stones to be cut in an identical fashion at a single time. As a result, the productivity of the faceting operation is increased and the cost thereof is reduced.

While the present invention has been broadly discussed in the context of faceting gemstones, it should be recognized that the machine could be used to form facets on other types of workpieces such as industrial diamonds and metals such as carbide steels for cutting tools and other hard steels for cutting and milling tools.

It is apparent that there has been provided in accordance with this invention a faceting machine which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A machine for simultaneously shaping a plurality of workpieces, said machine comprising:

a plurality of pin members in a cluster-like arrangement for holding said workpieces and for assisting in applying shaping forces to said workpieces;

said pin members being arranged in a contiguous and abutting relationship; and means for simultaneously moving said pin members to a desired angular position while retaining said pin members in said contiguous and abutting relationship so that substantially the same shaping forces are applied to each of said workpieces.

2. The machine of claim 1 further comprising:

means for abrading at least one surface of each said workpiece; and said simultaneous moving means comprises means for changing the angle of said pin members relative to said abrading means.

3. The machine of claim 1 further comprising:

means for retaining said plurality of pin members in said contiguous and abutting relationship.

4. The machine of claim 3 wherein said retaining means comprises at least one plate having a series of electromagnets associated therewith for holding said pin members together.

5. The machine of claim 3 wherein said retaining means comprises at least one holding plate for receiving said pin members.

6. The machine of claim 5 wherein said holding means comprises three spaced apart holding plates positioned along the length of the pin members,

7. The machine of claim 3 wherein said retaining means comprises at least one spring ring.

8. The machine of claim 3 wherein said retaining means includes a plate positioned above said pin members, said plate having electromagnetic means for holding said pins together.

9. A machine for shaping a plurality of workpieces, said machine comprising:

a plurality of pin members for holding said workpieces and for assisting in applying shaping forces to said workpieces;

said pin members being positioned together in a contiguous relationship;

means for abrading at least one surface of each said workpiece;

means for changing the angle of said pin members relative to said abrading means; and said angle changing means comprising an indexing pin positioned in a central location relative to said pin members and servo-control means for gyrating said indexing pin and for moving said indexing pin to a desired angle relative to a surface of said abrading means.

10. The machine of claim 9 further comprising:

said indexing pin being hinged adjacent one end to permit said angular changes and said gyrational movement of said indexing pin, whereby said servo-control means is used to cause gyrational movement of said indexing pin and thereby gyrational movement of said pin members.

11. The machine of claim 2 wherein said angle changing means comprises:

a first gear surrounding said pin members; and means for changing the angular relationship of said first gear relative to a surface of said abrading means.

12. A machine for shaping a plurality of workpieces, said machine comprising:

a plurality of pin members for holding said workpieces and for assisting in applying shaping forces to said workpieces;

said pin members being positioned together in a contiguous relationship;

means for abrading at least one surface of each said workpiece;

means for changing the angle of said pin members relative to said abrading means;

said angle changing means comprising a first gear surrounding said pin members and means for changing the angular relationship of said first gear relative to a surface of said abrading means; and said angular relationship changing means comprising a post extending substantially perpendicular to said surface of said abrading means, means for adjusting the angle of said first gear relative to said surface of said abrading means slidably mounted on said post, a plate member attached to said first gear, and said plate member being attached to said adjusting means by a hinge-type connection.

13. The machine of claim 12 wherein said angular relationship changing means further comprises:

means for rotating said main gear attached to said main gear.

14. The machine of claim 1 further comprising:

each of said pin members having a hollow tip portion for receiving an individual one of said workpieces and for maintaining a separation between adjacent workpieces.

15. The machine of claim 1 further comprising:

each of said pin members having an identically shaped outer surface to facilitate sliding action therebetween.

16. The machine of claim 15 wherein each pin member has a hexagonally shaped outer surface.

17. The machine of claim 2 wherein:

said abrading means comprising a rotating cutting lap.

18. The machine of claim 17 wherein:

said rotating cutting lap is positioned beneath said pin members.

19. The machine of claim 17 wherein:

said rotating cutting lap is positioned above said pin members.

20. The machine of claim 2 wherein:

said abrading means comprises a grinding device rotating about an axis substantially perpendicular to a plane containing said workpieces.

21. The machine of claim 20 further comprising:

said grinding wheel being movable along an axis substantially parallel to the plane containing said workpieces.

22. The machine of claim 20 further comprising:

said simultaneous moving means comprising means for gyrating and end of each said pin member remote from a surface of said grinding device along two orthogonal axes and thus through a 360° range of motion.

23. The machine of claim 22 wherein said gyrating means comprises a locking frame surrounding said pin members and a servo-control attached to said locking frame.

24. The machine of claim 1 further comprising:

each of said pin members being formed from at least one of steel, bronze and a plastic material.

25. A machine for simultaneously forming facets on at least one surface of a plurality of gemstones, said machine comprising:

a plurality of pin members in a cluster-like arrangement each having a longitudinal axis and means for holding one of said gemstones;

means for retaining said pin members in a contiguous and abutting relationship;

means for abrading said at least one surface of each of said gemstones;

said abrading means having a rotational axis; and means for simultaneously changing the orientation of all of said pin members with respect to a surface of said abrading means so that the longitudinal axes of all of said pin members are in a desired relationship with respect to the rotational axis of said abrading means.

26. The machine of claim 25 wherein said changing means induces a gyrational movement in said pin members.

27. The machine of claim 25 wherein said changing means positions said pin members at a desired angle relative to said rotational axis of said abrading means.

28. A process for shaping a plurality of workpieces which comprises the steps of:

(a) providing a rotatable lap having an abrading surface;

(b) providing a cluster of contiguous and abutting holding pin members, each holding pin member holding a workpiece to be shaped;

(c) simultaneously positioning all of said holding pin members in said cluster at a first desired angle with respect to said abrading surface while maintaining said holding pin members in said contiguous and abutting relationship; and (d) shaping said workpieces by rotating said lap and moving said holding pin members with respect to said abrading surface so that the workpieces contact said rotating lap and said holding pin members assist in applying shaping forces to the workpieces.

29. The process of claim 28 further comprising:

(e) moving said holding pin members so that said workpieces are no longer in contact with said abrading surface;

(f) repositioning all of said holding pin members at a second desired angle with respect to said abrading surface; and (g) repeating step (d).

30. A process for shaping a plurality of workpieces which comprises the steps of:

providing a rotatable lap having an abrading surface;

providing a plurality of contiguous holding pin members, each holding pin member holding a workpiece to be shaped;

simultaneously positioning all of said holding pin members at a first desired angle with respect to said abrading surface;

shaping said workpieces by rotating said lap and moving said holding pin members with respect to said abrading surface so that the workpieces contact said rotating lap and said holding pin members assist in applying shaping forces to the workpieces;

providing an indexing pin amongst said holding pin members; and said positioning step comprising moving said indexing pin relative to said abrading surface and thereby causing said simultaneous positioning of said holding pin members.

31. The process of claim 28 further comprising:

providing a gear which surrounds all of said holding pin members; and said positioning step comprising changing the angular relationship between said gear and said abrading surface and thereby causing said simultaneous positioning of said holding pin members.

32. The process of claim 31 further comprising:

rotating said gear during said shaping step.

* * * * *